US010047735B2

(12) United States Patent
Smith

(10) Patent No.: US 10,047,735 B2
(45) Date of Patent: Aug. 14, 2018

(54) MIXING PUMP

(71) Applicant: Perkins Engines Company Limited, Cambridgeshire (GB)

(72) Inventor: Paul J. Smith, Cambridgeshire (GB)

(73) Assignee: Perkins Engines Company Limited, Peterborough (GB)

( * ) Notice: Subject to any disclaimer, the term of this patent is extended or adjusted under 35 U.S.C. 154(b) by 879 days.

(21) Appl. No.: 14/366,815

(22) PCT Filed: Dec. 17, 2012

(86) PCT No.: PCT/GB2012/053165
§ 371 (c)(1),
(2) Date: Jun. 19, 2014

(87) PCT Pub. No.: WO2013/093441
PCT Pub. Date: Jun. 27, 2013

(65) Prior Publication Data

US 2014/0321230 A1 Oct. 30, 2014

(30) Foreign Application Priority Data

Dec. 19, 2011 (GB) ..... 1121844.3

(51) Int. Cl.
*F04B 13/02* (2006.01)
*F04C 2/10* (2006.01)
*B01F 15/02* (2006.01)
*F04C 11/00* (2006.01)

(52) U.S. Cl.
CPC ..... *F04B 13/02* (2013.01); *B01F 15/02* (2013.01); *F04C 2/102* (2013.01); *F04C 11/005* (2013.01); *F04C 2250/101* (2013.01); *Y10T 29/49238* (2015.01)

(58) Field of Classification Search
CPC ..... F04B 13/02
See application file for complete search history.

(56) References Cited

U.S. PATENT DOCUMENTS 2,484,789 A * 10/1949 Hill ..... F04C 2/102 418/152
2,966,118 A 12/1960 McAlvay
3,137,234 A * 6/1964 Mosbacher ..... F04C 2/102 418/1

(Continued)

OTHER PUBLICATIONS

EPO, International Search Report in International Patent Application No. PCT/GB2012/053165, 5 pp. (dated Jan. 27, 2014).

*Primary Examiner* — Abbas Rashid
(74) *Attorney, Agent, or Firm* — Leydig, Voit & Mayer, Ltd.

(57) ABSTRACT

The present disclosure relates to a mixing pump (10) for combining two or more substances. More specifically, the mixing pump (10) is adapted to combine controlled amounts of those substances so as to produce a mixture containing predetermined proportions of those substances. The mixing pump includes a chamber (23) lying in fluid communication with a first substance inlet (50), a second substance inlet (51) and a mixture outlet (52). The mixing pump (10) also includes a pumping member disposed in the chamber (23) and adapted to draw first and second substances from the first and second substance inlets (50,51) and to expel a mixture of those substances through the mixture outlet (52).

19 Claims, 14 Drawing Sheets

(56) References Cited

U.S. PATENT DOCUMENTS

| | | | | | |
|---|---|---|---|---|---|
| 3,453,966 | A * | 7/1969 | Eddy | F04C 2/102 | 418/54 |
| 3,520,518 | A | 7/1970 | Knedlik | | |
| 3,558,245 | A * | 1/1971 | Bolduc | F04C 2/105 | 251/261 |
| 3,910,733 | A | 10/1975 | Grove | | |
| 3,964,842 | A * | 6/1976 | White, Jr. | F04C 15/062 | 418/15 |
| 5,310,388 | A * | 5/1994 | Okcuoglu | B60K 17/20 | 475/88 |
| 6,270,169 | B1 * | 8/2001 | Harada | B60T 8/4031 | 303/115.1 |
| 6,386,836 | B1 * | 5/2002 | Johnson | F04C 11/001 | 417/310 |
| 6,793,472 | B2 * | 9/2004 | Dong | F04C 2/104 | 418/61.3 |
| 2010/0215537 | A1 * | 8/2010 | Chang | F04C 2/086 | 418/61.3 |
| 2010/0290934 | A1 | 11/2010 | Hadar et al. | | |

* cited by examiner

MIXING PUMP

CROSS-REFERENCE TO RELATED APPLICATIONS

This patent application is a U.S. National Phase Application of copending International Patent Application No. PCT/GB2012/053165, filed Dec. 17, 2012, which claims the benefit of United Kingdom Patent Application No. 1121844.3, filed Dec. 19, 2011, which are hereby incorporated by reference in their entireties.

TECHNICAL FIELD

The present disclosure relates to a pump and more particularly to a pump adapted to combine two or more substances.

BACKGROUND

Some installations consume or use various substances during operation. Some of those substances might need to be combined with other substances immediately prior to use to give them the required characteristics. For example, an engine may be configured to run on diesel or other conventional fuels, but may be adapted also to run on alternative fuels, such as biofuels, kerosene or other military grade fuels. Although those alternative fuels may include sufficient chemical energy for generating the required mechanical energy during combustion, they may lack the lubricity of the more conventional fuels. Many components rely on the natural lubricity of a substance to reduce wear and to enhance operation. For instance, a high-pressure fuel pump may rely on the lubricity of fuel for those same reasons. This shortcoming may be addressed by introducing a minor amount of a lubricant additive to the alternative fuel prior to use.

Two or more substances may be combined long before use, possibly at the point of preparation or perhaps later at the point of delivery. However, it is probable that the two or more substances may separate prior to use and possibly during storage as the most dense substance may settle towards the bottom of the storage tank.

Even if the two substances do not fully separate during storage, there is a concern that the homogeneity of the mixture may diminish over time, particularly if the two substances were mixed in an ineffective manner. The precise proportions of the two substances in the mixture may also be critical to the smooth operation of the installation for which the mixture is intended. It may not be practical to assess the proportions of substances in the mixture immediately before consumption so damage to the components may be inevitable and irreparable.

It is therefore an object of the present disclosure to provide an apparatus that may address the problems outlined above.

SUMMARY OF THE INVENTION

According to the present disclosure, there is provided a pump adapted to combine first and second substances, the pump comprising: a housing; a chamber defined in the housing; a first substance inlet in fluid communication with the chamber; a second substance inlet in fluid communication with the chamber; a mixture outlet in fluid communication with the chamber; and a pumping member disposed at least partially in the chamber and arranged to draw first and second substances from the first and second substance inlets and to expel a mixture of the first and second substances through the mixture outlet.

BRIEF DESCRIPTION OF THE DRAWINGS

By way of example only, one embodiment of the present disclosure will now be described in detail, with reference being made to the accompanying drawings, in which.

DETAILED DESCRIPTION

Figure 1:
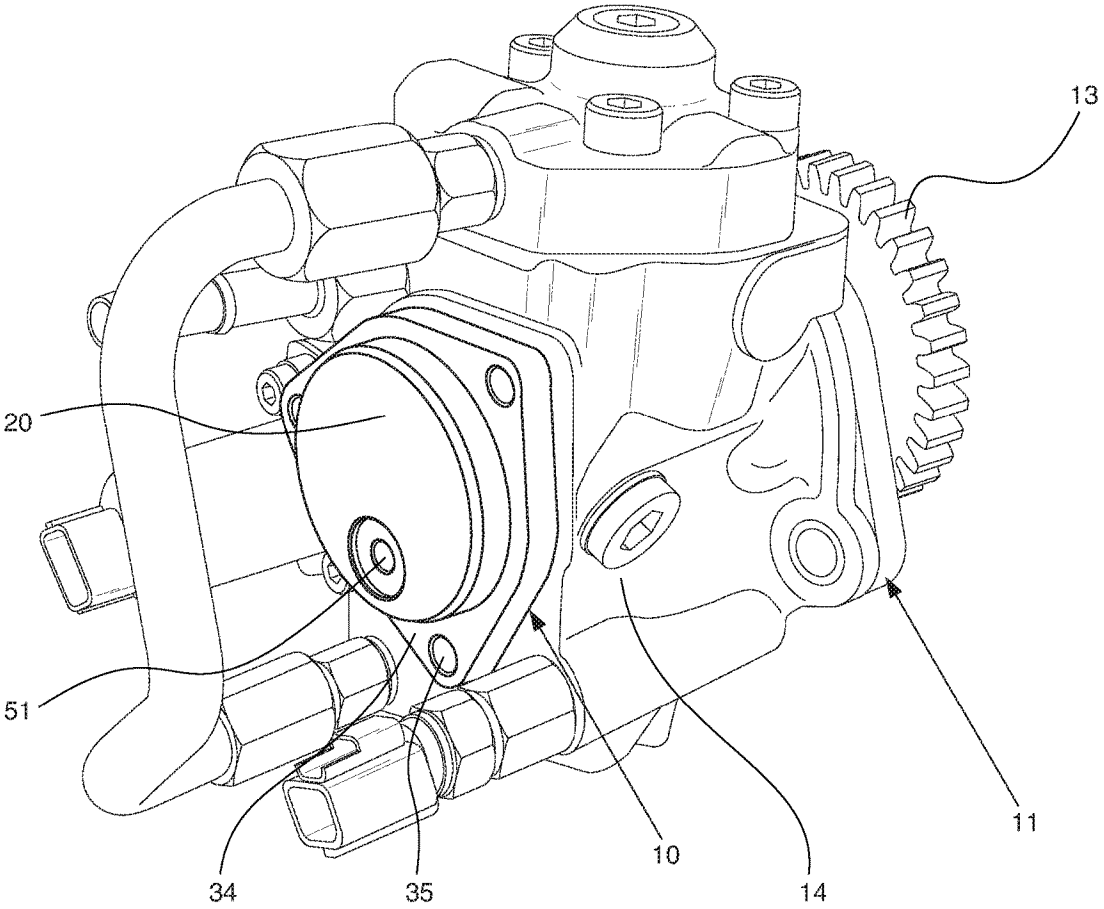
FIG. 1 is a perspective view of a mixing pump according to the present disclosure and mounted to an auxiliary component.

The following is a detailed description of an exemplary embodiment of the present disclosure. The exemplary embodiment described therein and illustrated in the drawings is intended to teach the principles of the present disclosure, enabling those of ordinary skill in the art to implement and use the present disclosure in many different environments and for many different applications. Therefore, the exemplary embodiment is not intended to be, and should not be considered as, a limiting description of the scope of patent protection. Rather, the scope of patent protection shall be defined by the appended claims.

Figure 2:
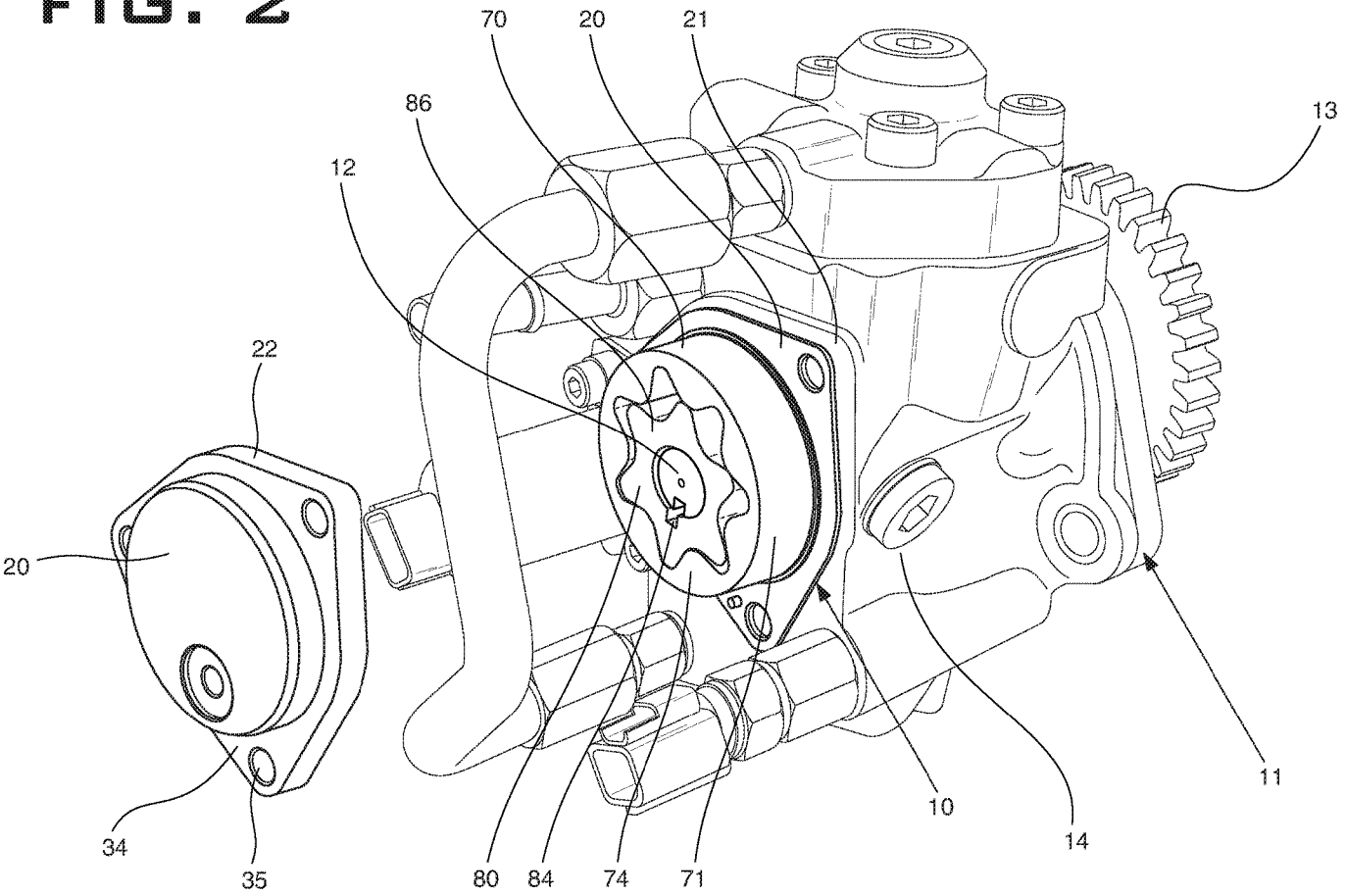
FIG. 2 is a perspective view of the mixing pump shown in FIG. 1, partially disassembled.
Figure 3:
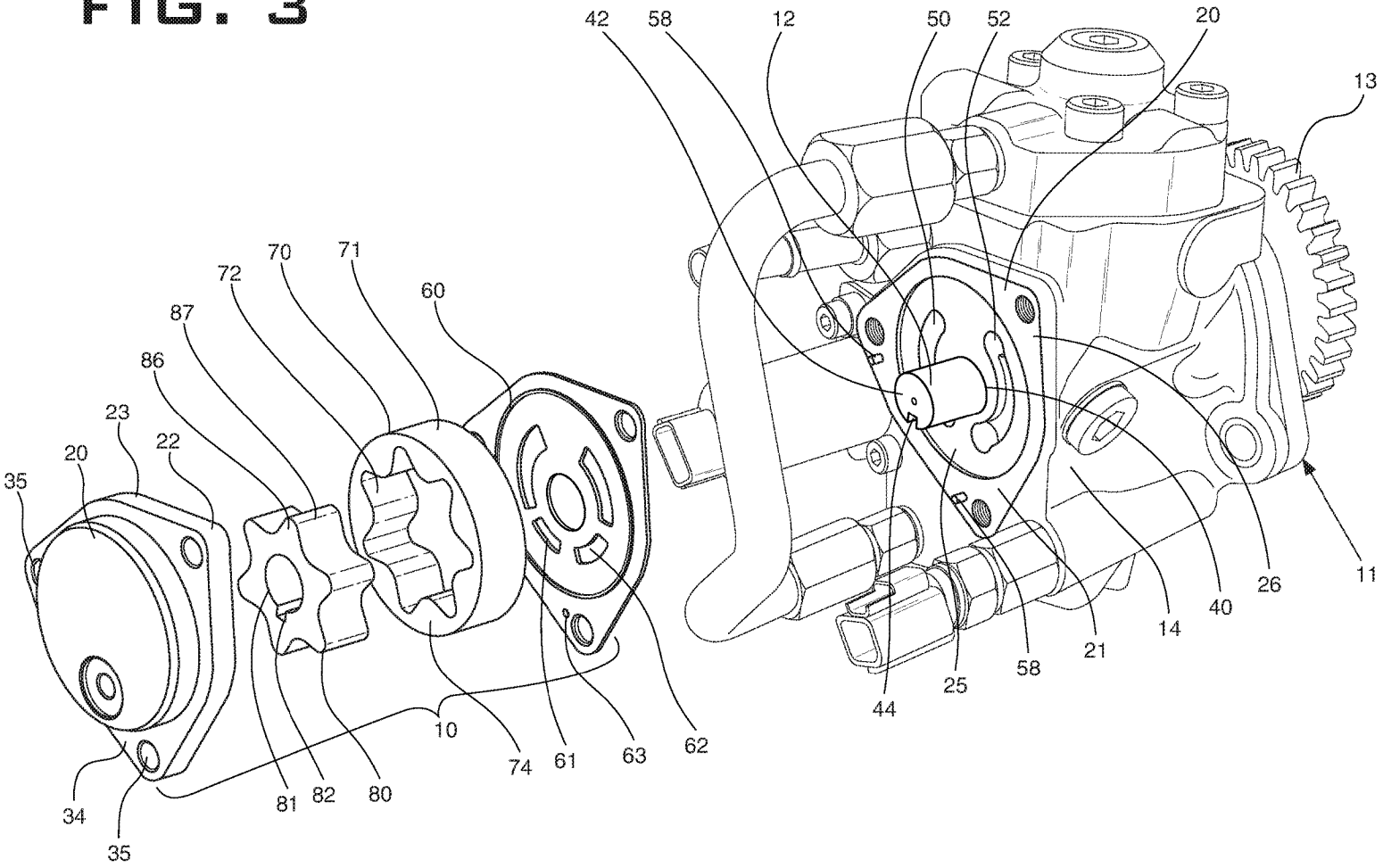
FIG. 3 is a perspective view of the mixing pump shown in FIGS. 1 and 2, fully disassembled.

Referring initially to FIGS. 1 to 3, there is shown a mixing pump 10, according to the present disclosure. The mixing pump 10 may comprise a linear or rotary pump capable of pressurizing a substance, which may comprise liquid, gaseous or particulate matter. In the present embodiment, the mixing pump 10 may comprise a gerotor, though in an alternative embodiment it may comprise a different rotary pump such as a gear pump, a vane pump, a lobe pump and so on.

In this particular embodiment, the mixing pump 10 may be mounted to a secondary pump 11 and both, the mixing pump and the secondary pump, may be driven by a common shaft 12 coupled to an engine or alternative drive means, such as an electric motor, via a gear 13. For instance, the mixing pump 10 may comprise a fuel transfer pump and the secondary pump 11 may comprise a high-pressure fuel pump, which may be integrated into a common housing 14 supporting the common shaft 12 and defining interconnecting passages (not shown). In an alternative embodiment (not shown) of the present disclosure, the mixing pump may be unitary in that it may be separate from any other component and as such it may have its own shaft, its own support means and its own passages.

The mixing pump 10 may include a mixing pump housing 20 comprising a first part 21 and a second part 22, which may collectively define a chamber 23, which may be cylindrical. The first part 21 may define a first sealing face 25, which may be substantially circular so as to form part of the chamber 23. In the present embodiment the first part 21 may also define a first mounting face 26 disposed at least partially around the first sealing face 25 for receiving the second part 22. The first sealing face 25 and the first mounting face 26 may be substantially co-planar and optionally delineated by sealing means, such as an O-ring (not shown). Alternatively, the first sealing face 25 may be spaced behind the first mounting face 26 so as to form a first recess (not shown) having a first peripheral face, which may be substantially circumferential. First fastening means may be associated with the first part 21 and may comprise for example, threaded holes 27 formed in the first mounting face 26 for receiving bolts (not shown) associated with the second part 22.

The second part 22 may include a second sealing face 30 which may be substantially circular and an inwardly facing second peripheral face 31 which may be substantially circumferential so as to surround the second sealing face 30. Collectively the second sealing face 30 and the second peripheral face 31 may define part of the chamber 23. The second part 22 may also include a second mounting face 33 disposed around the second peripheral face 31 and which is adapted to engage the first mounting face 26 of the first part 21. As such, the first and second mounting faces 26,33 may be correspondingly profiled and orientated. In the present embodiment, each of the first and second mounting faces 26,33 and the first and second sealing faces 25,30 may be substantially planar and may be arranged parallel to one another. The second part 22 may take the form of a cap furnished with an outwardly extending flange 34 extending at least partway around the outside of the second peripheral face 31. In the present embodiment the second mounting face 33 may extend entirely around the second peripheral face 31 and may have a generally triangular outline with slightly curved sides, though the outline may take any shape. The outwardly extending flange 34 may be provided with second fastening means arranged to cooperate with the first fastening means of the first housing part. For instance, the second fastening means may include three holes 35, the first fastening means may include three threaded holes with which the second fastening means align and screws may being arranged to extend into those holes.

As noted above, the mixing pump 10 may include a shaft 12 adapted for driving connection to an engine or alternative drive means, such as an electric motor. An opening 40 may be formed in one of the first and second sealing faces 25,30 for receiving the shaft 12. The opening 40 may be substantially circular and sized to form a close running fit with the shaft 12, thus restricting the egress of substance between the opening 40 and the shaft 12, in use. Furthermore, the centre of the opening 40 may be offset from the centre of the first and second sealing faces 25,30 such that the axis of the shaft 12 and the axis of the chamber 23 are not co-axial. The other of the first and second sealing faces 25,30 in which the opening 40 is not formed may be provided with a recess 41 arranged opposite the opening 40 so as to receive the free end 42 of the shaft 12. In the present embodiment, the first sealing face 25 includes the opening 40 and the second sealing face 30 includes the recess 41, thereby enabling the shaft 12 to extend from the secondary pump 11 and through the opening 40 such that the free end 42 locates in the recess 41. The shaft 12 may include shaft locking means 44, such as a slot extending at least partway along its length, which will be discussed in more detail below. The chamber 23 may include a notional reference line R defined by the shortest line extending between the shaft 12 and a point on the second peripheral face 31.

The mixing pump 10 may also be provided with a first substance inlet 50, a second substance inlet 51 and a mixture outlet 52, all defined within the mixing pump housing 20 and in fluid communication with the chamber 23. More specifically, the first substance inlet 50, the second substance inlet 51 and the mixture outlet 52 may be defined in the first sealing face 25, the second sealing face 30 or a combination of the both. The first substance inlet 50 and the second substance inlet 51 may be formed on one side of the reference line R and the mixture outlet 52 may be formed on the other side of the reference line R. In the present embodiment, the first substance inlet 50 and the mixture outlet 52 may be provided in the first sealing face 25 and the second substance inlet 51 may be defined in the second sealing face 30, possibly opposite the first substance inlet 50.

Depending on the desired proportions of the first and second substances in the mixture, it may be necessary to facilitate a relatively larger flow rate of one of the first and second substances. One method of achieving this is to increase the size of one of the first and second substance inlets 50,51, as required. In the present embodiment, the first substance inlet 50 may serve as a reservoir and may extend some way around one side of the chamber 23, possibly in an arcuate manner and may even widen as it extends away from the reference line R. The mixture outlet 52 may be correspondingly shaped on the other side of the reference line R.

Inlet and outlet shallows 55,56 may be formed in the second sealing face 30 and which may correspond in size, shape and or location with the first substance inlet 50 and the mixture outlet 52. These inlet and outlet shallows 55,56 may assist in reducing cavitation of the second sealing face 30 as the first substance enters the chamber 23 and the mixture exits the chamber.

One of the first and second mounting faces 26,33 may be furnished with at least one protuberance, such as a pin 58 for location in at least one aperture 59 formed in the other of the first and second mounting faces 26,33.

The mixing pump 10 may also be furnished with a sealing plate 60 disposed between the first and second parts 21,22 so as to overlie the first and second mounting faces 26,33. More specifically the sealing plate 60 may have an outline corresponding to that of the first and second mounting faces 26,33 and may include cut-outs 61,62,63 corresponding substantially to the first substance inlet 50, the mixture outlet 52 and the at least one protuberance 58. The sealing plate 60 may serve as a gasket to seal the interface between the first and second parts 21,22 of the mixing pump housing 20.

Figure 4:
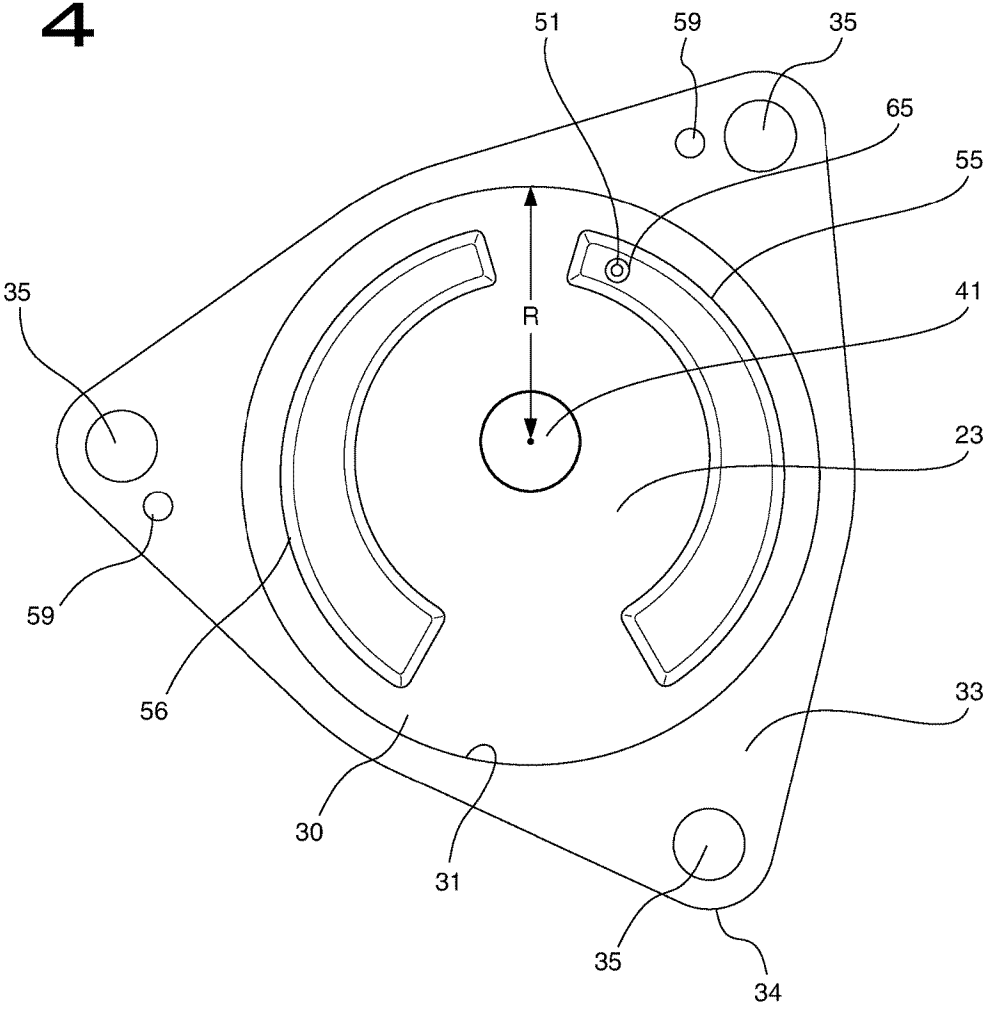
FIG. 4 is a plan view of a housing forming part of the mixing pump shown in FIGS. 1 to 3.
Figure 5:
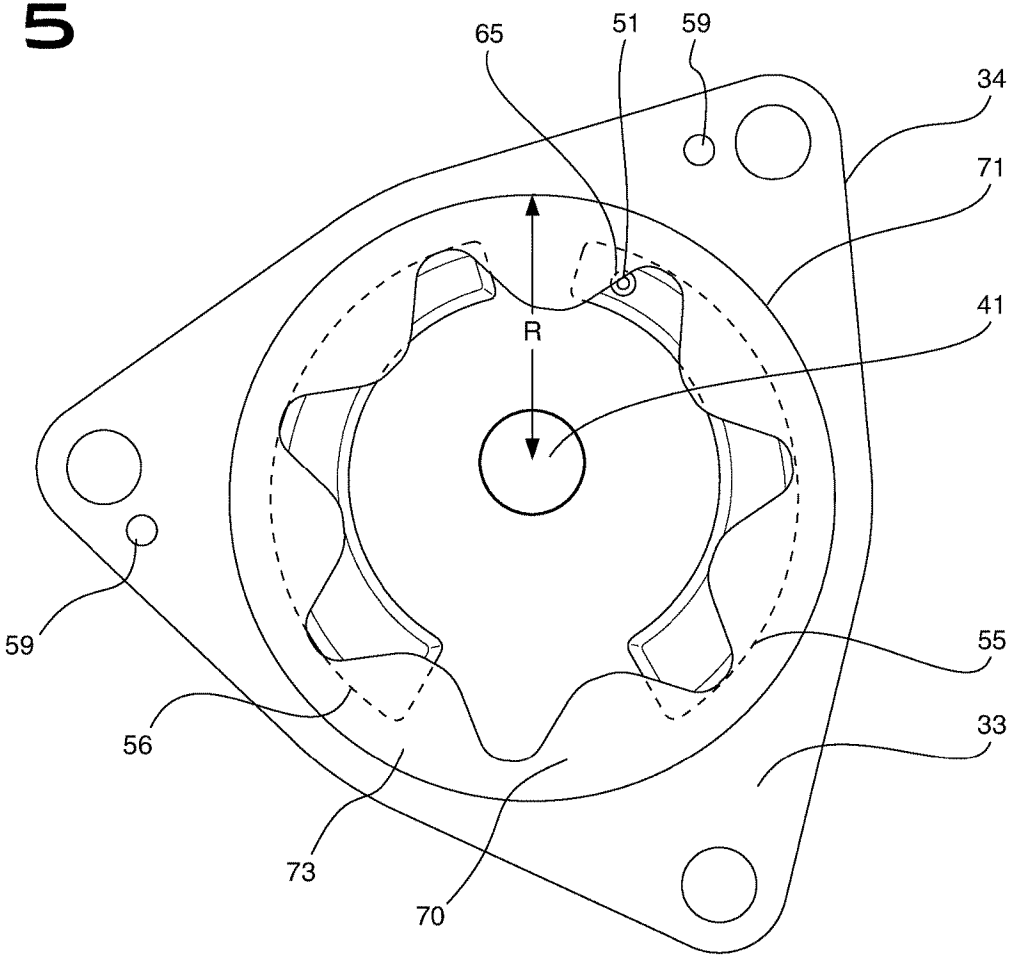
FIG. 5 is a plan view of the housing shown in FIG. 4 with an outer rotor disposed therein.
Figure 9:
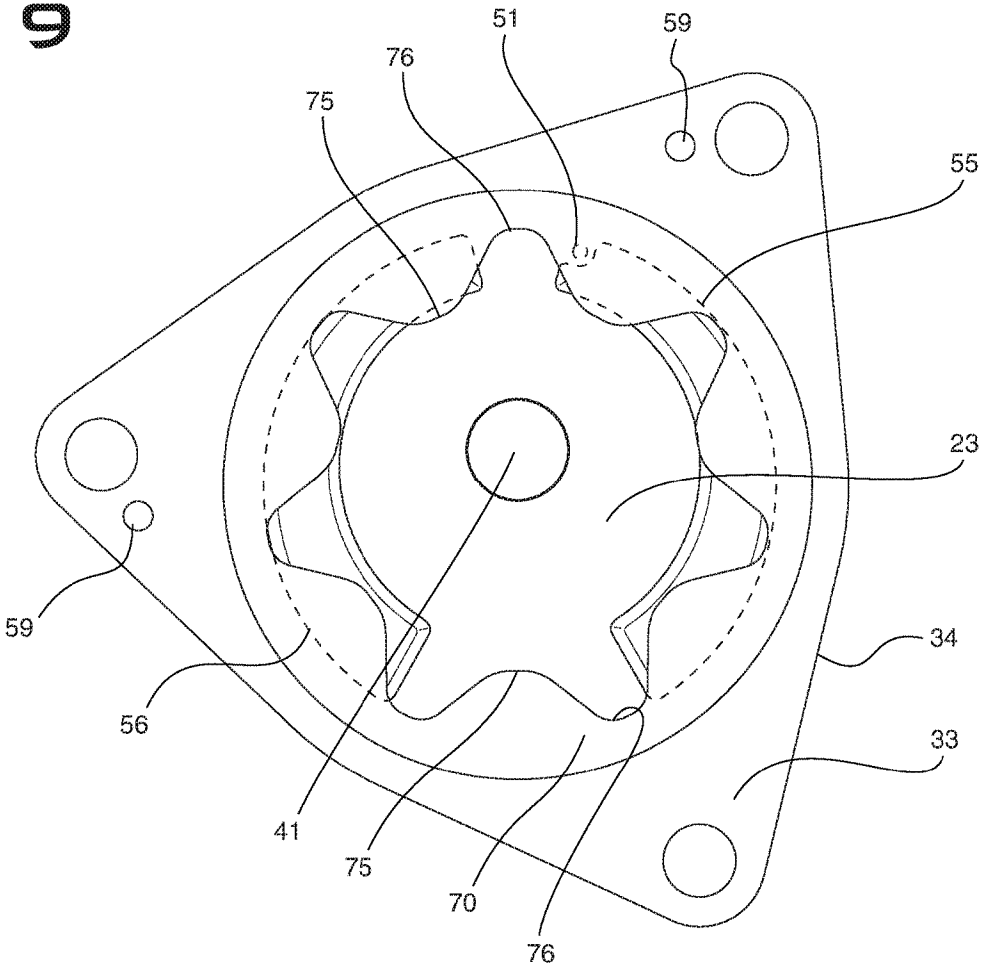
FIG. 9 is a plan view of an alternative housing with the outer rotor arranged in a reference position.

In the present embodiment of the disclosure, the second substance inlet 51 may be formed on the second sealing face 30 and may be substantially smaller than the first substance inlet 50, so as to create a mixture having a greater proportion of first substance than second substance. As noted above, the relative sizes of the first and second substance inlets may be selected according to the first and second substance proportions in the mixture. The second substance inlet 51 is here formed in the second sealing face 30 reasonably close to the reference line R, for reasons discussed below. Referring briefly to a first arrangement shown in FIG. 4, the second substance inlet 51 is defined within the inlet shallow 55 and surrounded by a land 65 being generally coplanar to the second sealing surface 30. In a second arrangement shown in FIG. 9, the second substance inlet 51 is located just outside the inlet shallow 55 so as to be disposed a little closer to the reference line R.

An outer rotor 70 is disposed within the chamber 23 for rotation about the central axis thereof. The outer rotor 70 may be generally annular and may include a circumferential outer face 71, an undulating inner face 72, a first side 73 and a second side 74. The circumferential outer face 71 may be sized to form a close running fit with the second peripheral face 31 of the chamber and the undulating inner face 72 may define a plurality of inwardly facing teeth 75 spaced apart by troughs 76. The first and second sides 73,74 are profiled to correspond to the first and second sealing faces 25,30, respectively, and may be domed, conical or, as with the present embodiment, substantially planar. The clearance between the first sealing face 25 and the first side 73 and the second sealing face 30 and the second side 74 may be selected to form a close running fit. More specifically, the clearance may be selected to enable the outer rotor 70 to rotate within the chamber 23 while restricting the flow of substance between those surfaces.

The mixing pump 10 may also include an inner rotor 80 which may be carried on the shaft 12 and disposed within the chamber 23 so as to locate within the outer rotor 70. The inner rotor 80 includes an opening 81 in its centre through which the shaft 12 extends and locking means 82 arranged to prevent relative rotation of the inner rotor 80 and the shaft 12. The locking means 82 may comprise a slot extending axially along the inner rotor 80 adjacent one side of the opening 81 and which may be aligned with the slot 44 on the shaft 12 so that they may together receive a locking member 84 such as a key to prevent relative rotation of the shaft 12 and the inner rotor 80.

The inner rotor 80 has first and second sides 85,86 forming a close running fit with the first and second sealing faces 25,30 of the chamber 23 and an undulating outer face 87 defining a plurality of outwardly facing teeth 88 and troughs 89. The number of teeth 88 and troughs 89 on the inner rotor 80 should be selected according to the number of inwardly facing teeth 75 and troughs 76 on the outer rotor 70, though it should be borne in mind that the inner rotor 80 may include one less tooth 88 and one less trough 89 than the outer rotor 70. In the present example the inner rotor 80 includes six teeth 88 and six troughs 89 compared to the outer rotor 70 which includes seven teeth 75 and seven troughs 76. Furthermore, the troughs 89 of the inner rotor 80 and the teeth 75 of the outer rotor may be complementary. In the present embodiment, the teeth 88 of the inner rotor 80 and the troughs 76 of the outer rotor 70 may be complementary and may be substantially the same size and shape.

Figure 10:
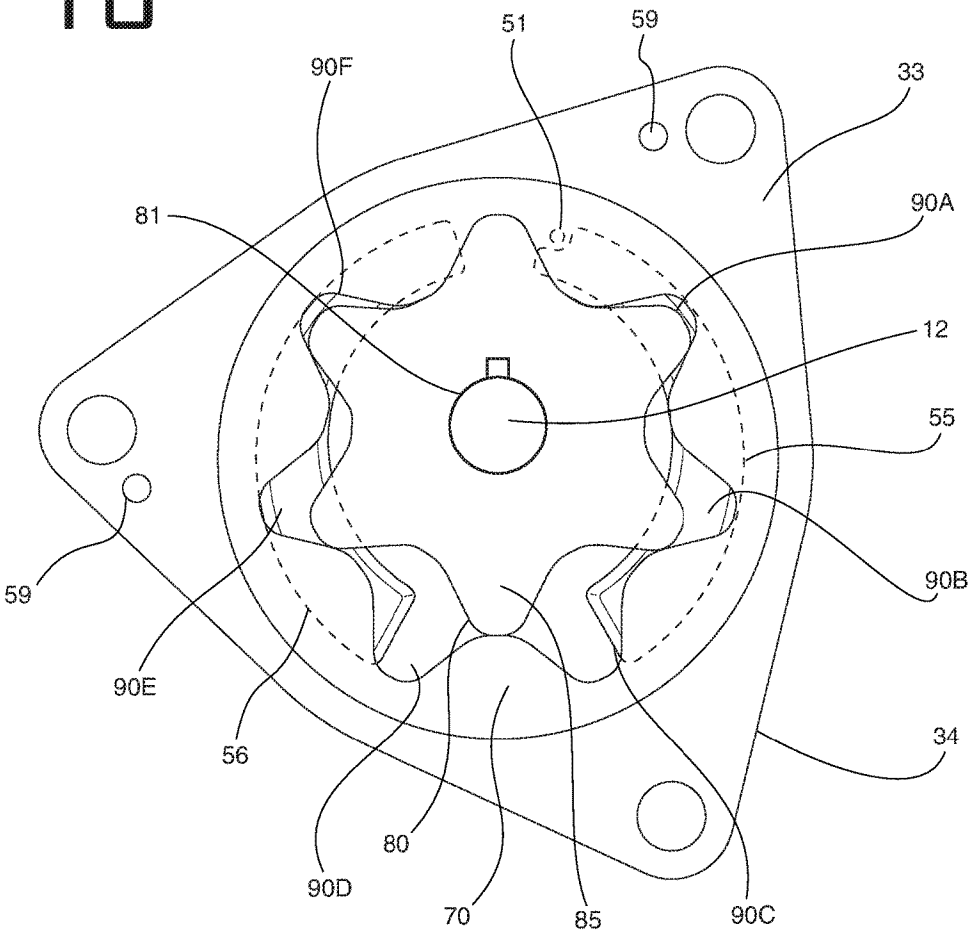
FIG. 10 is a plan view of the alternative housing of FIG. 9, with the inner and outer rotors arranged in a reference position.
Figure 11:
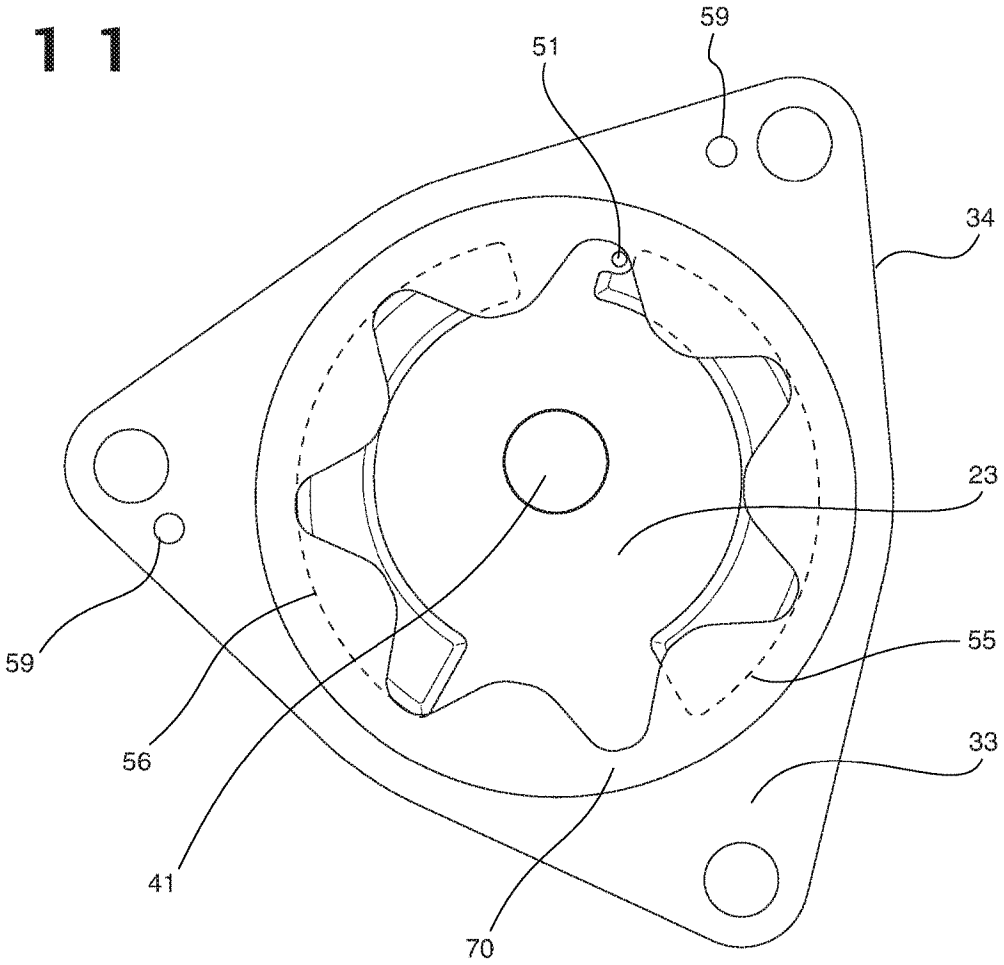
FIG. 11 is a plan view of the alternative housing of FIGS. 9 and 10 with the outer rotor displaced from the reference position.
Figure 12:
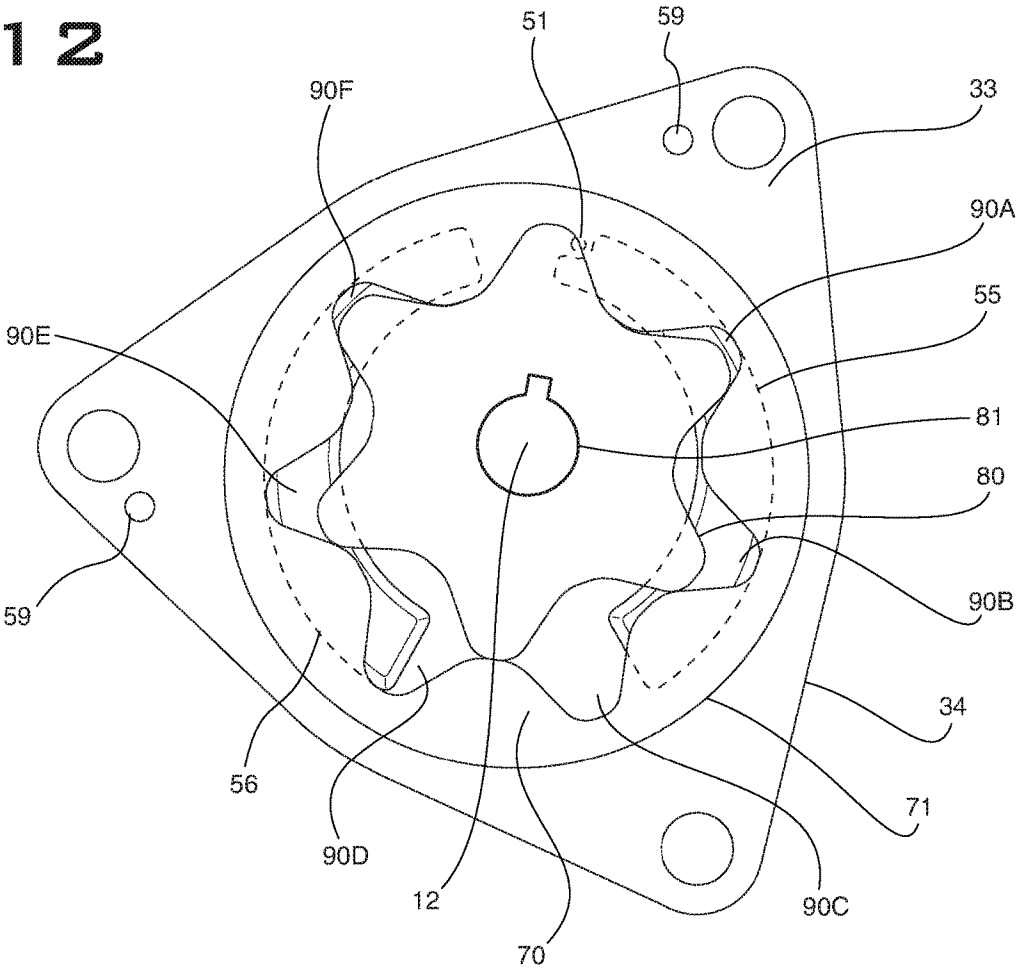
FIG. 12 is a plan view of the alternative housing of FIGS. 9 to 11 with the inner and outer rotors displaced from the reference position.

The position of the shaft 12 within the chamber 23 is selected having regard to the size and shape of the teeth 88,75 and the troughs 89,76 of the inner and outer rotors 80,70. In particular, the position of the shaft 12 may be selected so that one tooth 88 of the inner rotor 80 fits snugly inside one trough 76 of the outer rotor 70 when that tooth 88 and that trough 76 locate centrally over the reference line R, see FIGS. 8 and 10. The reference line R may be the only location where a tooth 88 of the inner rotor 80 may fit snugly within a trough 76 of the outer rotor 70. At all other locations the teeth 88 of the inner rotor 80 may fit only partially within the troughs 76 of the outer rotor 70, thereby defining sub-chambers 90A-90F between the inner and outer rotors 80,70. As the inner and outer rotors 80,70 rotate about their respective axes, the size of each sub-chamber 90A-90F increases and decreases as it moves away from and towards the reference line R, respectively.

It will be appreciated that the position of the second substance inlet 51 can be selected according to the amount of second substance to be dispensed and thus the relative proportions of first and second substances in the resulting mixture expelled through the mixture outlet 52. More specifically, if the second substance inlet 51 is arranged proximal to the reference line R where the sub-chamber 90A is at its smallest the opportunity for second substance to be drawn is minimal. Conversely, if the second substance inlet 51 is distal to the reference line where the sub-chamber 90C is at its largest, the opportunity for second substance to be drawn is maximal. The second substance inlet 51 may be located in a notional circumferential track (not shown) having an outer circumferential boundary defined by the base of each trough 76 of the outer rotor 70 and an inner circumferential boundary defined by the peak of each tooth 75 of the outer rotor 70. This way, the delivery of second substance into the chamber 23 is always intermittent as the second substance inlet 51 may be alternately opened and closed by the teeth 75 of the outer rotor 70 and, to some extent, the teeth 88 of the inner rotor 80. The opening time may be greater when the second substance inlet is arranged at a location distal to the reference line R and lesser when arranged at a location proximal to the reference line R.

Figure 13:
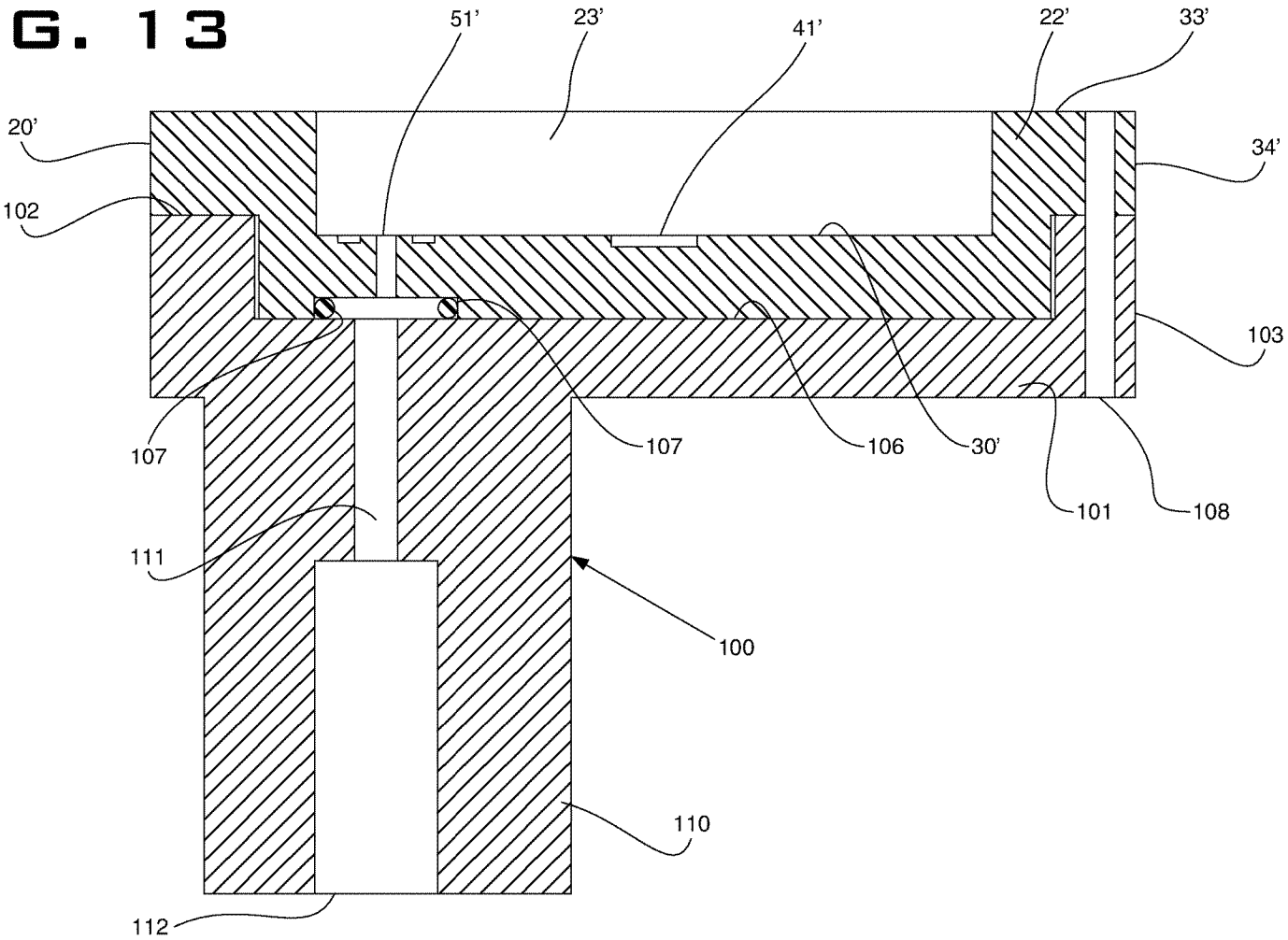
FIG. 13 is a cross-section through part of the mixing pump of the present disclosure.
Figure 15:
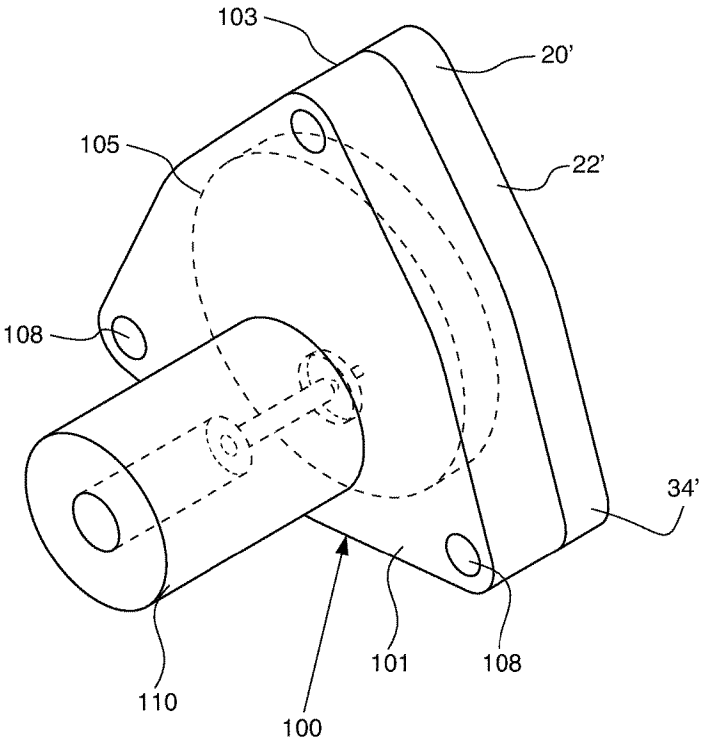
FIG. 15 is a perspective view of the components shown in FIG. 14 disassembled.
Figure 14:
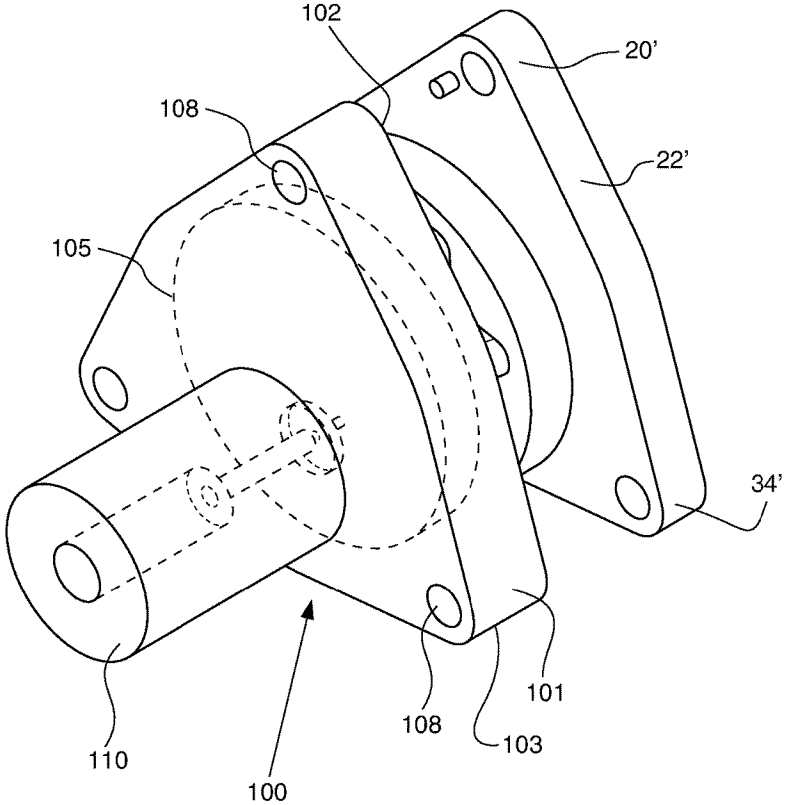
FIG. 14 is a perspective view of the components shown in FIG. 13.

FIGS. 13 to 15 disclose an adaptor generally indicated 100 for converting a known pump (such as a gerotor) into a mixing pump 10 according to the present disclosure. The adaptor 100 may comprise a body 101 configured for connection to the pump housing 20' of the gerotor. The body 101 has a mounting face 102 arranged to overlie a second part 22' of the pump housing 20' and an outer periphery 103 corresponding substantially to the outline of the flange 34'. The body 101 may include a recess 105 in its mounting face 102 for receiving the second part 22' of the housing of the mixing pump. The recess 105 includes an abutment face 106 arranged to engage sealingly a portion of the second part 22' in which the second substance inlet 51' is formed. To improve the sealing characteristics, the abutment face 106 or the second part 22' may be furnished with a seal member 107, such as an O-ring arranged to surround the second substance inlet.

Three openings 108 may be formed in the body 101 and in alignment with the fastening means 35' formed in the second part 22' so as to secure the adaptor 100 to the pump housing 20' of the pump 10'.

The adaptor 100 may include a connection portion 110 extending outwardly from the body 101 and which may define a second substance duct 111 arranged to align with the second substance inlet 51' formed in the second part 22'. The second substance duct 111 may include a diametrically larger section 112 remote from the abutment face 106 for receiving a second substance supply conduit (not shown).

The diametrically larger section 112 may be threaded to receive a threaded connector provided on the end of the conduit.

INDUSTRIAL APPLICABILITY

During manufacturing the mixing pump 10, the size and positions of the first and second substance inlets 50,51 should be selected according to the proportion of first substance and second substance in the mixture. If the mixture is to comprise substantially equal proportions of first and second substances then the size and position of the first and second substance inlets 50,51 should be selected so that equally sized areas of those first and second substance inlets 50,51 are on average open for equal amounts of time. In the present embodiment, the first substance may comprise a low lubricity fuel, the second substance may comprise a lubricant and the resulting mixture may comprise a high lubricity fuel. Thus, the resulting mixture should include a relatively low proportion of lubricant, by volume, and a high proportion of the low lubricity fuel, by volume. To achieve that proportion, the first substance inlet 50 may be large and may extend across the width of the notional circumferential track. Conversely, the second substance inlet 51 may be small, possibly 0.1 $mm^2$, and disposed proximal to the reference line R. The second substance inlet 51 of the first arrangement (FIGS. 4 to 8) and the second substance inlet 51 of the second arrangement (FIGS. 9 to 12) are substantially the same size, though the second substance inlet 51 of the second arrangement is located a little closer to the reference line R, which would result in a lower proportion of second substance in the mixture.

In the present embodiment, the pressures of the first and second substances are substantially equal at the first and second substance inlets 50,51 and thus the proportions of those substances in the resultant mixture may be determined according to the positions and sizes of the first and second inlets. In alternative arrangements, the pressures of the first and second substances may be unequal at the first and second substance inlets 50,51. For example, the pressure of the second substance at the second substance inlet 51 may be substantially lower than the pressure of the first substance at the first substance inlet 50, thereby reducing the proportion of second substance in the resulting mixture.

Referring to the first arrangement shown in FIGS. 4 to 8, as the shaft 12 and the inner rotor 80 rotate in a clockwise direction about the offset axis of the shaft 12, its teeth 88 engage the inwardly facing teeth 75 of the outer rotor 70, which is caused to rotate in the clockwise direction about the central axis of the chamber 23. The chamber 23 is divided into six sub-chambers: three 90A-90C of which lie in communication with the first substance inlet 50 and draw first substance therefrom; and the other three 90D-90F lie in communication with the mixture outlet 52 and deliver mixture thereto. The six sub-chambers 90A-90F move in the clockwise direction with the inner and outer rotors 80,70 and while so doing, the size of each of the sub-chambers 90A-90C in the vicinity of the first substance inlet 50 increases and the size of each of the sub-chambers 90D-90F in the vicinity of the mixture outlet 52 decreases.

Figure 6:
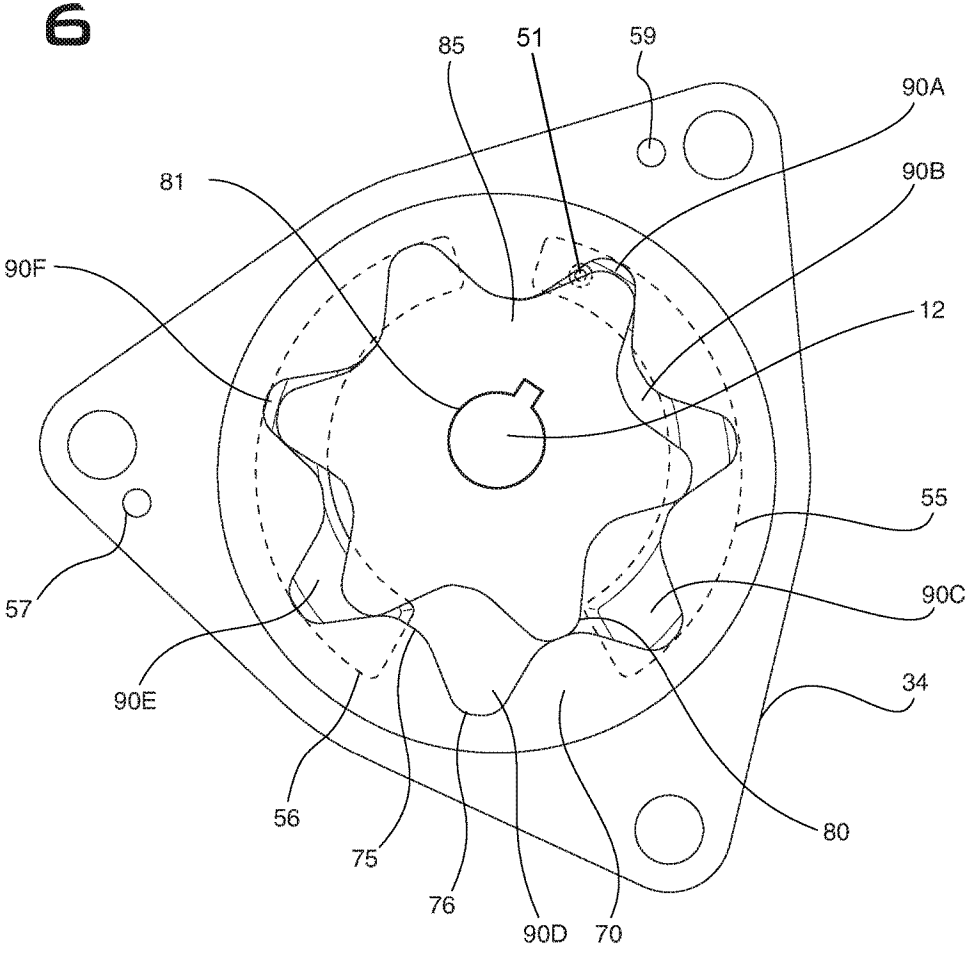
FIG. 6 is a plan view of the housing shown in FIGS. 4 and 5 with the inner and outer rotors disposed therein.
Figure 7:
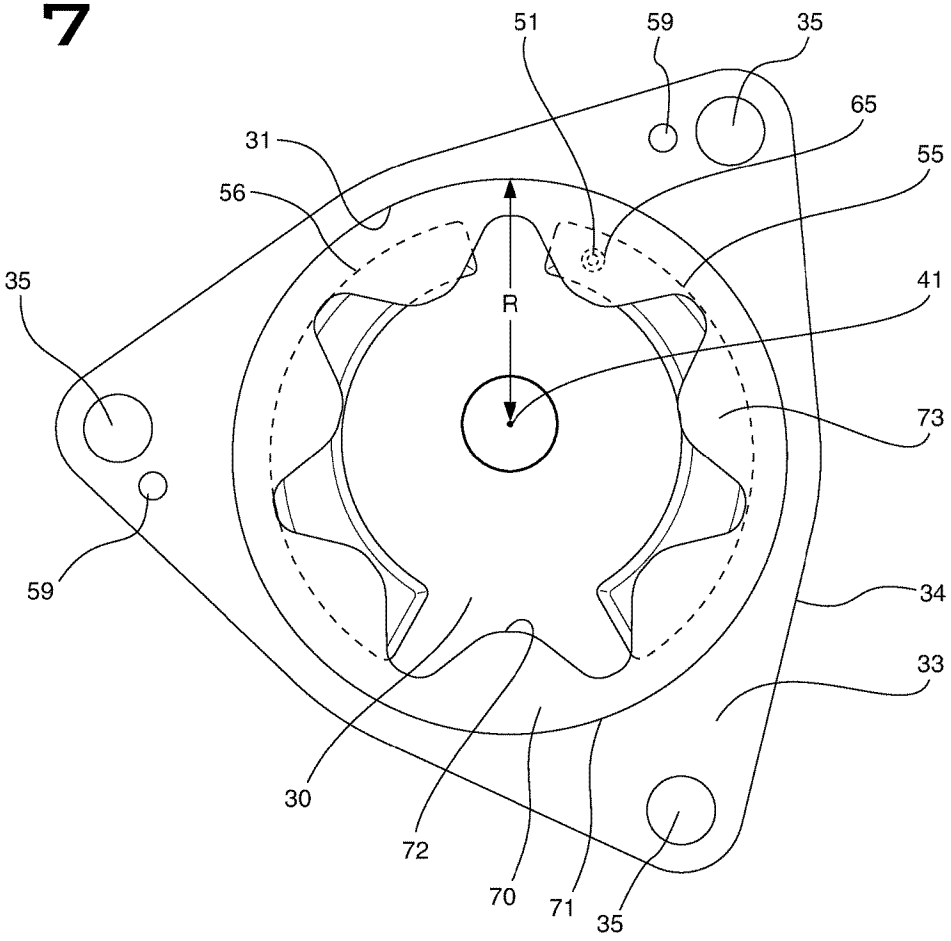
FIG. 7 is a plan view of the housing shown in FIGS. 4 to 6, with the outer rotor arranged in a reference position.
Figure 8:
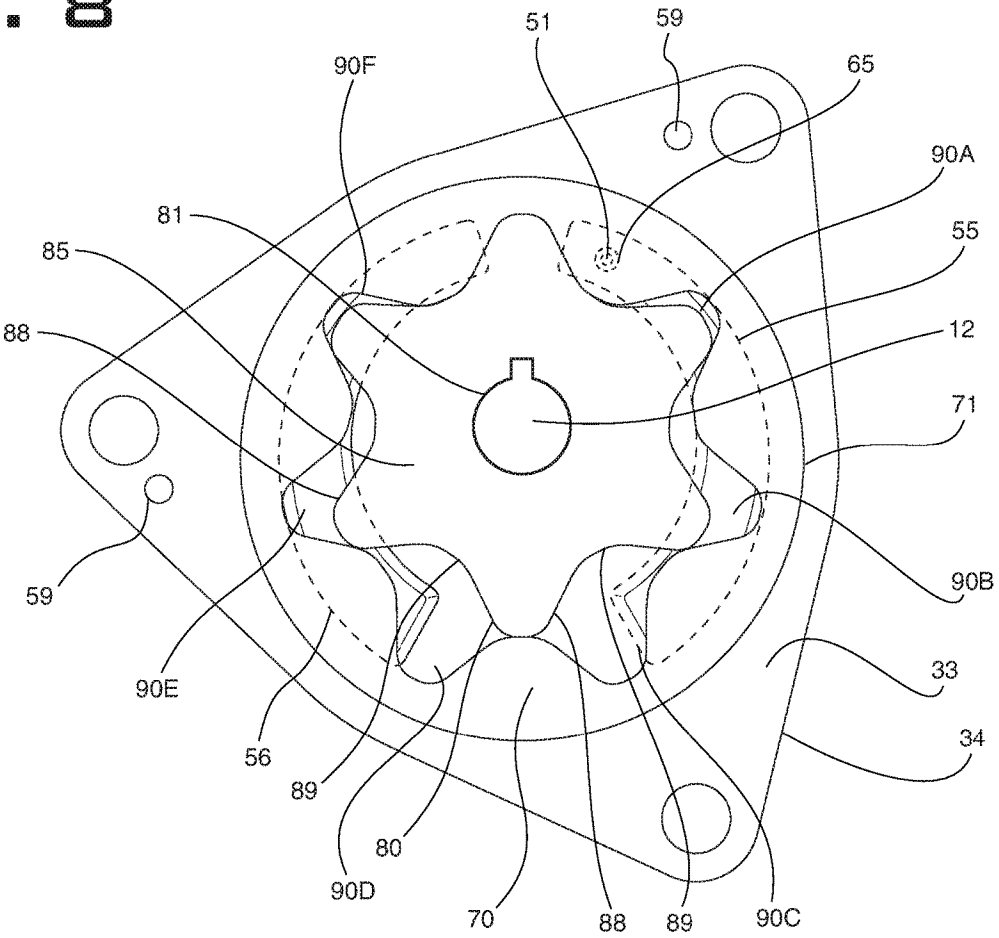
FIG. 8 is a plan view of the housing shown in FIGS. 4 to 7, with the inner and outer rotors both arranged in the reference position.

As a new tooth 88 of the inner rotor 80 passes the reference line R a sub-chamber in the vicinity of the mixture outlet 52 disappears and a new sub-chamber in the vicinity of the first substance inlet 50 emerges. In FIG. 6, the first sub-chamber 90A is in fluid communication with both the first substance inlet 50 and the second substance inlet 51 thereby causing first and second substances to be drawn into that sub-chamber 90A. As the inner and outer rotors 80,70 rotate, the sub-chamber 90A rotates in the clockwise direction and increases in size while maintaining fluid communication only with the first substance inlet 50, as shown in FIG. 8. Incidentally, FIG. 8 shows the inner and outer rotors 80,70 in reference positions whereat one tooth 88 of the inner rotor 80 lies centrally over the reference line R and fits snuggly within a trough 76 of the outer rotor 70. Sub-chamber 90A continues to increase in size and to draw more first substance from the first substance inlet 50. Eventually the sub-chamber 90A may move around to the mixture outlet 52 whereat it decreases in size and thus expels the mixture of the first and second substances into the mixture outlet 52.

The second arrangement shown in FIGS. 9 to 12 operates in the same manner as the first arrangement shown in FIGS. 4 to 8. As noted above, the second substance inlet 51 of the second arrangement is located closer the reference line R so the amount of second substance drawn therefrom is restricted even more. This is because the size of each sub-chamber is always very small in the location of that second substance inlet 51 and as such there is little opportunity for drawing second substance into the sub-chamber 90A at that location.

What is claimed is:

1. A pump adapted to combine first and second substances, the pump comprising:

a housing defining a chamber, a first substance inlet, a second substance inlet, and a mixture outlet therein;

an outer pumping member disposed within the chamber; and an inner pumping member disposed radially within the outer pumping member, the housing, the outer pumping member, and the inner pumping member defining a pumping sub-chamber, a volume of the pumping sub-chamber being configured to vary with a rotational position of the inner pumping member relative to the housing, the first substance inlet being in intermittent fluid communication with the pumping sub-chamber according to a first relationship with the rotational position of the inner pumping member relative to the housing, the second substance inlet being in intermittent fluid communication with the pumping sub-chamber according to a second relationship with the rotational position of the inner pumping member relative to the housing, the mixture outlet being in intermittent fluid communication with the pumping sub-chamber according to a third relationship with the rotational position of the inner pumping member relative to the housing, the pumping sub-chamber being arranged to draw the first and second substances from the first and second substance inlets and to expel a mixture of the first and second substances through the mixture outlet, wherein a first position of the inner pumping member relative to the outer pumping member effects fluid communication between the pumping sub-chamber and both the first substance inlet and the second substance inlet, and wherein a second position of the inner pumping member relative to the outer pumping member effects fluid communication between the pumping sub-chamber and the first substance inlet and blocks fluid communication between the pumping sub-chamber and the second substance inlet.

2. The pump as claimed in claim 1, wherein the pump is one of a gear pump, a lobe pump, a gerotor, and a vane pump.

3. The pump as claimed in claim 1, wherein:
the pump is a gerotor;
the chamber is substantially cylindrical so as to define a central axis, first and second circular faces, and a circumferential face;
the outer pumping member is an outer rotor having n+1 inwardly facing teeth;
the inner pumping member is an inner rotor having n outwardly facing teeth for variable engagement with the inwardly facing teeth of the outer rotor; and
the outer rotor is arranged for rotation about the central axis of the chamber and the inner rotor is arranged for rotation about an offset axis lying substantially parallel to and spaced apart from the central axis of the chamber.

4. The pump as claimed in claim 3, wherein a plurality of sub-chambers are defined between the outwardly facing teeth of the inner rotor and the inwardly facing teeth of the outer rotor,
the pumping sub-chamber being one sub-chamber of the plurality of sub-chambers, and
a smallest sub-chamber of the plurality of sub-chambers is defined at or near a notional reference line extending radially from the offset axis to a nearest point on the circumferential face of the chamber.

5. The pump as claimed in claim 4, wherein the first substance inlet and the mixture outlet are disposed on opposed sides of the notional reference line.

6. The pump as claimed in claim 3, wherein the first substance inlet and the second substance inlet are both arranged in the first circular face.

7. The pump as claimed in claim 3, wherein the first substance inlet is arranged in the first circular face and the second substance inlet is arranged in the second circular face.

8. The pump as claimed in claim 7, wherein the second substance inlet is arranged in the second circular face at a location that is substantially opposite the first substance inlet formed in the first circular face.

9. The pump as claimed in claim 7, further comprising:
a first substance recess formed on the second circular face and arranged substantially opposite the first substance inlet; and
a land defined within the first substance recess that is substantially co-planar with a remainder of the second circular face, the second substance inlet being defined within the land.

10. The pump as claimed in claim 3, wherein the second substance inlet is arranged on a circumference that is intersected by the inwardly facing teeth so as to be intermittently closed as the outer rotor rotates within the chamber.

11. The pump as claimed in claim 4, wherein a size of the second substance inlet and a location of the second substance inlet relative to the notional reference line determine, at least in part, an amount of the second substance introduced into the chamber.

12. The pump as claimed in claim 3, wherein the housing comprises a first part and a second part together defining the chamber,
the first part being provided on an auxiliary component and defining:
the first circular face;
the first substance inlet provided on the first circular face; and
the mixture outlet provided on the first circular face; and
the second part defining:
the circumferential face;
the second circular face; and
the second substance inlet provided on the second circular face.

13. The pump as claimed in claim 12, further comprising a pump adaptor detachably mountable to the housing, the pump adaptor defining
an inlet passage adapted to communicate fluidly with the second substance inlet formed in the second part, and
connection means adapted to connect the inlet passage to a second substance supply.

14. A method for converting a pump into a mixing pump that is capable of combining two or more substances, the pump including
a housing defining a chamber, a first inlet, and an outlet;
an outer pumping member disposed within the chamber; and
an inner pumping member disposed radially within the outer pumping member,
the housing, the outer pumping member, and the inner pumping member defining a pumping sub-chamber, a volume of the pumping sub-chamber being configured to vary with a rotational position of the inner pumping member relative to the housing,
the first inlet being in intermittent fluid communication with the pumping sub-chamber according to a first relationship with the rotational position of the inner pumping member relative to the housing,
the outlet being in intermittent fluid communication with the pumping sub-chamber according to a second relationship with the rotational position of the inner pumping member relative to the housing, the method comprising:
forming a second inlet in the housing, the second inlet being in intermittent fluid communication with the pumping sub-chamber according to a third relationship with the rotational position of the inner pumping member relative to the housing;
providing an adaptor defining a duct having a pump orifice and a connector orifice; and
attaching the adaptor to the pump such that the pump orifice lies in fluid communication with the second inlet, and the connector orifice is capable of being connected to a second substance supply,
the pumping sub-chamber being arranged to draw the two or more substances from the first inlet and the second inlet, and to expel a mixture of the two or more substances through the outlet,
wherein a first position of the inner pumping member relative to the outer pumping member effects fluid communication between the pumping sub-chamber and both the first inlet and the second inlet, and
wherein a second position of the inner pumping member relative to the outer pumping member effects fluid communication between the pumping sub-chamber and the first inlet and blocks fluid communication between the pumping sub-chamber and the second inlet.

15. The pump as claimed in claim 8, further comprising:
a first substance recess formed on the second circular face and arranged substantially opposite the first substance inlet; and
a land defined within the first substance recess that is substantially co-planar with a remainder of the second circular face, the second substance inlet being defined within the land.

16. The pump as claimed in claim 4, wherein the first substance inlet and the second substance inlet are both arranged in the first circular face.

17. The pump as claimed in claim 4, wherein the first substance inlet is arranged in the first circular face and the second substance inlet is arranged in the second circular face.

18. The pump as claimed in claim 17, wherein the second substance inlet is arranged in the second circular face at a location that is substantially opposite the first substance inlet formed in the first circular face.

19. The pump as claimed in claim 6, further comprising a first substance recess formed on the first circular face, the second substance inlet being defined outside of the first substance recess.

* * * * *